US006196455B1

(12) United States Patent
Robinson

(10) Patent No.: US 6,196,455 B1
(45) **Date of Patent: *Mar. 6, 2001**

(54) RANGE AND DROP CALCULATOR FOR USE WITH TELESCOPIC GUN SIGHTS

(76) Inventor: Bruce N. Robinson, P.O. Box 1535, Los Lunas, NM (US) 87031

( * ) Notice: Subject to any disclaimer, the term of this patent is extended or adjusted under 35 U.S.C. 154(b) by 0 days.

This patent is subject to a terminal disclaimer.

(21) Appl. No.: 09/018,498

(22) Filed: Feb. 4, 1998

(51) Int. Cl.[7] ..... F41G 1/38; F41G 11/00
(52) U.S. Cl. ..... 235/70 A; 33/245; 42/101
(58) Field of Search ..... 235/70 A; 33/245; 42/101, 100

(56) References Cited

U.S. PATENT DOCUMENTS 543,612 * 7/1895 Colby ..... 235/70 A
2,094,623 * 10/1937 Stokey .
2,539,256 * 1/1951 Leupold .
3,627,199 * 12/1971 Hill .
3,750,757 * 8/1973 Saetti .
3,814,308 * 6/1974 Kolan .
3,908,112 * 9/1975 Lo et al. .
3,933,305 * 1/1976 Murphy .
3,948,587 * 4/1976 Rubbert .
4,037,518 * 7/1977 Lorenzen .
4,189,634 * 2/1980 LaBove et al. .
4,285,137 * 8/1981 Jennie .
4,308,449 * 12/1981 Kelley .
4,329,570 * 5/1982 Koll ..... 235/70 A
4,361,752 * 11/1982 Holmes .
4,584,776 * 4/1986 Shepherd .
4,772,780 * 9/1988 Reed et al. .
5,960,576 * 10/1999 Robinson ..... 42/90

OTHER PUBLICATIONS

"Ohms Law Calculator/Parallel Resistance Calculator", custom manufactured in USA for Radio Shack, a Division of Tandy Corporation, Ft. Worth, Texas.*

Shawlee, Walter, "The Wonderful World of Perrygrafs", Internet address, www.sphere.bc.ca, Nov. 30, 1997, Canada 10 pages.*

* cited by examiner

*Primary Examiner*—Stephen M. Johnson
(74) *Attorney, Agent, or Firm*—Rod D. Baker

(57) ABSTRACT

A hand-held analog calculator apparatus, and method for use thereof in the field, in association with firearms. The apparatus permits the user of a high-powered rifle equipped with a telescopic sight having a mildot reticle to quickly determine the range to target and the necessary elevation adjustment to compensate for bullet drop. Various logarithmic scales are disposed upon two rule members which slide parallel past each other. The scales display values corresponding to the mildot measurement, estimated target size, known bullet drop, and the like. By manipulating the rule members to align certain selected marks on particular scales, first the range to target value and then the necessary gun sight elevation adjustment and/or sight hold-over values are displayed on other scales. An interchangeable alternative rule member is provided to permit the invention to be used to calculate in either metric or English dimensional units.

27 Claims, 8 Drawing Sheets

RANGE AND DROP CALCULATOR FOR USE WITH TELESCOPIC GUN SIGHTS

BACKGROUND OF THE INVENTION

A portion of the disclosure of this patent document contains material which is subject to copyright protection. The owner has no objection to the facsimile reproduction by anyone of the patent document or the patent disclosure, as it appears in the Patent and Trademark Office patent file or records, but otherwise reserves all copyright rights whatsoever.

1. Field of the Invention (Technical Field)

The present invention relates to an apparatus and method for determining in the field the range to target, and for adjusting the sight/aiming point to compensate for bullet drop or drift at that range, for a firearm, specifically for a firearm equipped with a telescopic sight having a mildot type of reticle.

2. Background Art

The mildot reticle is in increasingly widespread use by long-range rifle shooters as a means of estimating the range to the target. This estimation is critical in order to correct for the varying degree of projectile drop (and/or wind drift) at different ranges and thereby enable the shooter to hit the target. With training and familiarization, and by using the mildot reticle and then making the appropriate calculations, an experienced marksman can accurately estimate the range to target.

Initially incorporated into telescopic gun sights designed for military (and later police) use, the mildot reticle is the object of growing acceptance in the civilian sector among target shooters and hunters. By using a set of fixed dots within the telescopic sight, the shooter can compare the size of a target, a portion of the target, or a nearby reference target when viewed through the sight to the series of precisely sized and spaced dots on the reticle. On a mildot reticle, the dots are uniformly center-to-center spaced at 1 mil, which spacing appears to subtend a length of approximately 36 inches on a target viewed at 1000 yards. By estimating the size of the target or a reference near the target, and noting the number of mils that equal the size of the target, the shooter can apply a formula to calculate the range to target. This formula is simply expressed as: size of target in yards multiplied by 1000, and that product then divided by size of target in mils, equals range in yards. Currently, this calculation is performed in the field using a conventional hand-held calculator.

The present method of using a mildot reticle poses several serious challenges to the shooter. The necessary calculations are somewhat complex, and depend upon the shooter's ability to correctly remember and apply the formula. Dimensional analysis further complicates the process, as the size of the target more often than not is mentally estimated in inches, necessitating an additional calculation to convert the target size into a decimal equivalent of yards. The shooter generally must carry and use an electronic digital calculator, necessitating numerous data entry steps.

Even after the shooter has performed the range calculation procedure, the amount of the bullet drop (or wind drift) applicable to the known range must be applied to the sight picture to enable an accurate aim that will result in a hit on target. Either the telescopic sight must be mechanically adjusted, or the sighting point (the intersection of the cross hairs) "held over," to correct the elevation (and/or windage) of the gun barrel to compensate for the effects of gravity and/or wind. Determining this compensation necessitates a second series of calculations to convert the needed amount of elevation or windage correction into a gun sight adjustment or hold-over figure for the known range and load.

Besides presenting many opportunities for arithmetic error, the correction calculations are time consuming, which may prove problematic in certain scenarios, such as military or law enforcement counter-sniping operations, timed competitive target-shooting events, or hunting situations.

A need remains, therefore, for a calculator apparatus which eliminates the multiple data entry steps and simplifies the calculation procedures for determining range to target and/or elevation adjustment to compensate for bullet drop or drift over the range determined. The present invention was developed to satisfy this previously unmet need.

SUMMARY OF THE INVENTION (DISCLOSURE OF THE INVENTION)

The present invention relates to an analog calculator apparatus and method incorporating two rule members, slidably connected together and bearing logarithmic and inverse logarithmic scales, configured and controllably movable specifically to perform the following operations: (1) rapid and simple calculation of range to target, based on a measurement of the target with a mildot reticle, by aligning the estimated target dimension value on one scale directly opposite the mildot value on a second scale, and then reading from a third scale the range to target value aligned with an index mark; and (2) rapid and simple calculation of the amount of gunsight correction necessary to compensate for bullet drop and/or wind drift for a given distance to target, enabling the user to determine either the equivalent telescopic sight adjustment (minute-of-angle) or the equivalent hold-over (mils), by aligning an index with a range value on one scale, and reading an elevation compensation value in both minute-of-angle and mils, on a second scale directly opposite a bullet drop value on a third scale.

In accordance with the invention, there is provided an apparatus, useable with a telescopic sight having a mildot reticle, for determining the distance to a target of a known dimension. In one embodiment, the apparatus comprises: a first rule member; a second rule member controllably moveable adjacent to the first rule member; a mildot scale, comprising mil value marks, on the first rule member; a range scale, comprising range value marks, on the first rule member; at least one index point on the second rule member proximate to the range scale; and a target dimension scale, comprising dimension value marks, on the second rule member substantially parallel to the mildot scale. The preferred embodiment is used by controllably moving the second rule member to align a dimension value mark corresponding to the known dimension with a selected mil value mark on the mildot scale, with the result that one of the at least one index points is substantially aligned with a range value mark corresponding to the distance to the target. Preferably, the first rule member comprises an oblong rectilinear shape defining a rectangular aperture therethrough, and the aperture is disposed parallel between the mildot scale and the range scale. In the preferred embodiment, the second rule member comprises an oblong rectilinear shape movably disposed through slots in the first rule member, so that the second rule member is controllably movable axially within the aperture parallel to the first rule member. Preferably, a mildot reticle facsimile is provided on the first rule member parallel to the mildot scale. Also, optionally, means are disposed on the first rule member for determining a range correction factor for vertically angled shots.

The foregoing described embodiment is useful for determining range to target. Thus, according to the invention also is provided an apparatus, useable with a firearm having a known bullet drop over a known distance, for determining an adjustment to firearm elevation to compensate for bullet drop. The apparatus preferably comprises: a first rule member; a second rule member controllably moveable adjacent to the first rule member; a range scale, comprising range value marks, on the first rule member; at least one elevation scale, comprising elevation value marks, on the first rule member; at least one index point on the second rule member proximate to the range scale; and a bullet drop scale, comprising drop value marks, on the second rule member substantially parallel to the at least one elevation scale. Preferably, in use the second rule member is controllably moved to align one of the at least one index point with a selected range value mark corresponding to the known distance, with the result that a drop value mark corresponding to the known bullet drop is substantially aligned with an elevation value mark on the at least one elevation scale corresponding to the adjustment to firearm elevation. Again, the first rule member preferably comprises an oblong rectilinear shape defining a rectangular aperture therethrough, and the aperture is disposed parallel between the at least one elevation scale and the range scale. Also, the second rule member preferably comprises an oblong rectilinear shape movably disposed through slots in the first rule member, so that the second rule member is controllably movable axially within the aperture parallel to the first rule member. Also, optionally but preferably, there is provided means on the second rule member for determining a bullet drop value for the known distance.

One preferred embodiment of the invention performs both the rangefinder function and the elevation adjustment functions with a single apparatus. In this embodiment, a single apparatus is provided useable with a firearm having a telescopic sight including a mildot reticle and having a known bullet drop over a known distance, for determining the distance to a target of a known dimension and for determining an adjustment to firearm elevation to compensate for bullet drop. The calculator apparatus thus comprises: a first rule member; a second rule member controllably moveable adjacent to the first rule member; a mildot scale, comprising mil value marks, on the first rule member; a first range scale, comprising first range value marks, on the first rule member; at least one first index point on the second rule member proximate to the first range scale; a target dimension scale, comprising dimension value marks, on the second rule member substantially parallel to the mildot scale; a second range scale, comprising second range value marks, on the first rule member; at least one elevation scale, comprising elevation value marks, on the first rule member; at least one second index point on the second rule member proximate to the second range scale; and a bullet drop scale, comprising drop value marks, on the second rule member substantially parallel to the at least one elevation scale. In this embodiment, when the second rule member is controllably moved to align a dimension value mark corresponding to the known dimension with a selected mil value mark on the mildot scale, one of the at least one first index points is substantially aligned with a first range value mark corresponding to the distance to the target, and when the second rule member is controllably moved to align one of the at least one second index points with a selected second range value mark corresponding to the distance to the target, a drop value mark corresponding to the known bullet drop is substantially aligned with an elevation value mark on the at least one elevation scale corresponding to the adjustment to firearm elevation.

The invention also includes a method of determining range and elevation compensation generally in accordance with the foregoing summary, and shall be further described. Also, an alternative embodiment of the invention includes optional components to permit the apparatus to be used to perform either metric or English dimensional calculations.

A primary object of the present invention is to provide a rugged, non-digital, apparatus for quickly and simply determining both range to target and correction of barrel elevation for firearms equipped with telescopic sights having a mildot reticle.

A primary advantage of the present invention is that it radically simplifies for users of mildot telescopic sights the calculations of range to target and elevation adjustment.

Another advantage of the invention is the provision of a calculator that is rugged, durable, easy to use, and requires no electrical power source.

Still another advantage of the present invention is the provision of a calculator apparatus which may be operated rapidly and quietly in the field, even in conditions of inclement weather.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1:
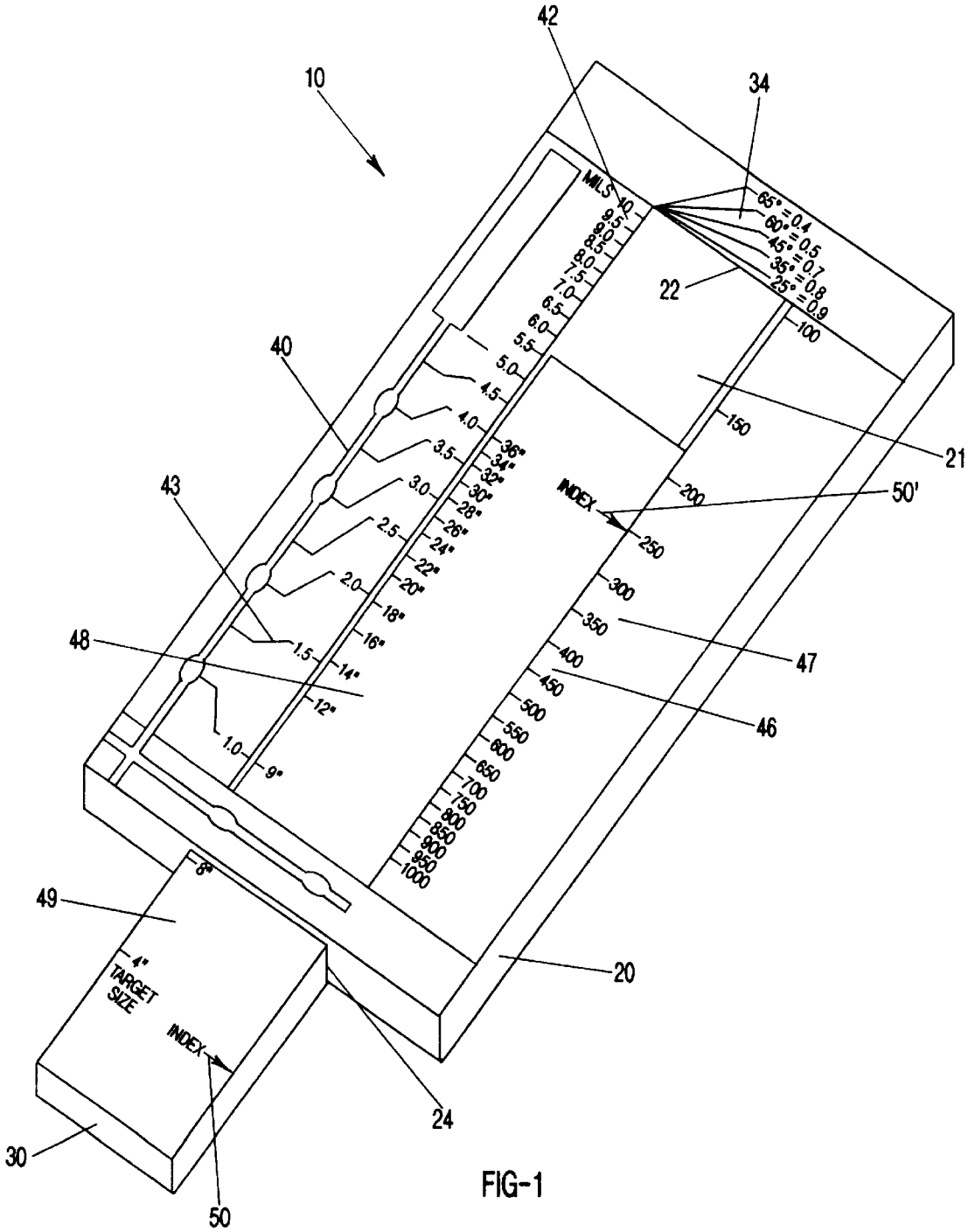
FIG. 1 is a perspective view of a preferred embodiment of the invention showing a first rule member and a second rule member.

DESCRIPTION OF THE PREFERRED EMBODIMENTS (BEST MODES FOR CARRYING OUT THE INVENTION)

The invention is an apparatus for use by sportsmen and sportswomen, military personnel or law enforcement personnel equipped with firearms having telescopic sights. It is contemplated that the telescopic sight typically is mounted upon a high-powered rifle, but the invention may find alternative uses with telescopic sights attached to other types of firearms. To be suited for use in combination with the invention, the telescopic sight has a particular type of reticle (commonly also called "cross hairs") known as a "mildot" reticles. The apparatus is useable in the field for simply and rapidly determining approximate range to a target, and approximate adjustment to barrel elevation to compensate for bullet drop. The invention will find beneficial use in hunting, particularly big-game hunting, where the sportsman may have but a single opportunity to make an accurate long-distance shot. The invention also has military and law-enforcement applications, where the soldier or policeman is required to make long-distance shots with a high degree of accuracy, such as sniping or hostage rescue situations. The shooting enthusiast practicing long-range target shooting will also find the invention useful.

A preferred embodiment, broadly described, is a two-piece, hand-held, apparatus which permits the user to quickly and reliably improve his shooting accuracy in the field. The apparatus is reminiscent of a slide rule in that it includes ruled scales which may be slidably manipulated to perform analog calculations.

The apparatus of the invention is intended to be used in operative association with a telescopic sight having a mildot reticle. A reticle, generally defined, is a grid or rule placed in the eyepiece of the scope and used to establish position. A pair of perpendicular line reticles in the scope form the familiar "cross hairs" pattern used to establish the position of the barrel of the gun; when the intersection of the reticles is on the target when the target is viewed through the scope, the barrel of the gun is presumed to be aimed at the target. Reticles known in the art have a series of uniformly spaced hash marks defining a graduated pattern along the length of the reticle. A "mildot" reticle has dots or ovoid marks about 0.25 mils (milliradians) long that are uniformly spaced at 1.0 mil. The mildot reticle scope is constructed such that the angle subtended by an object occupying the apparent distance between two mildots, when viewed through a ten-power (10X) scope, is one milliradian. Accordingly, an object one meter wide in the field, when viewed through the scope from a distance of 1000 meters, will appear to occupy the distance between the centers of two adjacent mildots on the reticle.

Thus, using tacheometric principles borrowed from the art of land surveying, the graduated scale on the reticle permits the distance between the scope and the target to be estimated when the size of the target is known. By observing through the scope the number of mildot intervals (and partial intervals) apparently occupied by a target when viewed through the scope, the distance to target may be determined if the size of the target is known or may be reasonably accurately estimated.

FIG. 1 shows that one preferred embodiment of the inventive analog calculator 10 features two rule members 20, 30 fashioned from plastic, wood, or other suitable durable, substantially rigid material. Most preferably, the rule members 20, 30 are molded from plastic or resin composite to provide durability under adverse field (e.g. moisture, rough handling) conditions as well as minimal coefficient of thermal expansion. Alternative, inexpensive embodiments may be fashioned from cardboard, plastic laminated paper, or the like. Materials which significantly expand and contract with changes in temperature should be avoided, as thermal expansion potentials adversely affects the accuracy of the invention. Since the calculator 10 typically is used outdoors, it may be subjected to extremes in temperature.

Preferably, the calculator 10 is sized for convenient use in the field. The device is suited for easy two-handed manipulation, and thus preferably should be from about 4.0 to about 12.0 cm wide, from about 12.0 to about 25.0 cm long, and from approximately 0.5 to 1.5 cm thick, although these dimensions are by way of example rather than limitation. Accordingly, the length, width, and thickness of the calculator 10 ideally permit the calculator to be hand-held in use, or stowed in a vest or pants pocket, or in a small exterior pocket on a knapsack or backpack when not in use.

As seen in FIG. 1, the first rule member 20 preferably has a planar, oblong, rectilinear frame-like shape featuring a peripheral solid portion circumscribing and defining an oblong longitudinal window or rectangular aperture 21 therethrough. The second rule member 30 also is generally planar with an oblong rectangular shape generally corresponding in size to the aperture 21 in the first rule member 20. The second rule member 30 accordingly is considerably narrower in lateral extent than the first rule member 20. The second rule member 30 preferably has a longitudinal dimension substantially equal to the overall length of the first frame member 20, although alternative embodiments may feature a longer second rule member 30.

The second rule member 30 is controllably movable adjacent to the first rule member 20. The first rule member 20 has in its ends a pair of slots 22, 24, corresponding generally in size and shape to the cross sectional size and shape of the second rule member 30, and penetrating the first rule member 20 longitudinally from its respective ends to the aperture 21. As suggested by the directional arrow in FIG. 1, the second rule member 30 is slidably insertable through the slots 22, 24 so that when thus inserted, the second rule member 30 is maintained in parallel relation to the first rule member 20. While disposed through the first rule member 20, the majority of the length of the second rule member 30 is visible through the aperture 21. The second rule member 30 has an oblong rectilinear shape movably disposed through the slots 22, 24 in the first rule member 20, and the second rule member 30 is controllably movable axially within the aperture 21, parallel to the first rule member 20. Desirably, the longitudinal edges of the aperture 21 are defined by tenons or ridges projecting inwardly from the first rule member 20, which are slidably engageable with mortises or grooved channels running along the longitudinal edges of the second rule member 30. Such slidable mortise-type joints serve to maintain the rule members 20, 30 in parallel movable conjunction throughout the full travel of the rule members, particularly when either end of the second rule member 30 happens to be withdrawn out of its nearby slot 22 or 24 during practice of the invention. By pulling and/or pushing on the ends of the second rule member 30 while holding steady the first rule member 20, the user is able controllably to move the second rule member 30 parallel to the first rule member 20. The second rule member 30 is sized to provide a mild frictional resistance to sliding movement of the rules 20, 30 with respect to each other, to reduce the likelihood of the rules inadvertently sliding apart and out of parallel contact.

In the preferred embodiment, the generally planar calculator 10 has an obverse face 25 and a reverse face 27, both of which preferably feature functional elements of the invention. The obverse face 25, seen in FIGS. 1 and 2, has rangefinder scales printed or engraved thereon which will be further described. The reverse face 27, which is viewed by simply turning the calculator 10 over, displays elevation adjustment scales thereon which also shall be described in detail. By making consecutive reference first to the obverse face 25 and then the reverse face 27 of the calculator 10, the user of the invention is able to perform a pair of related calculations using the single apparatus, as described herein below.

Figure 2:
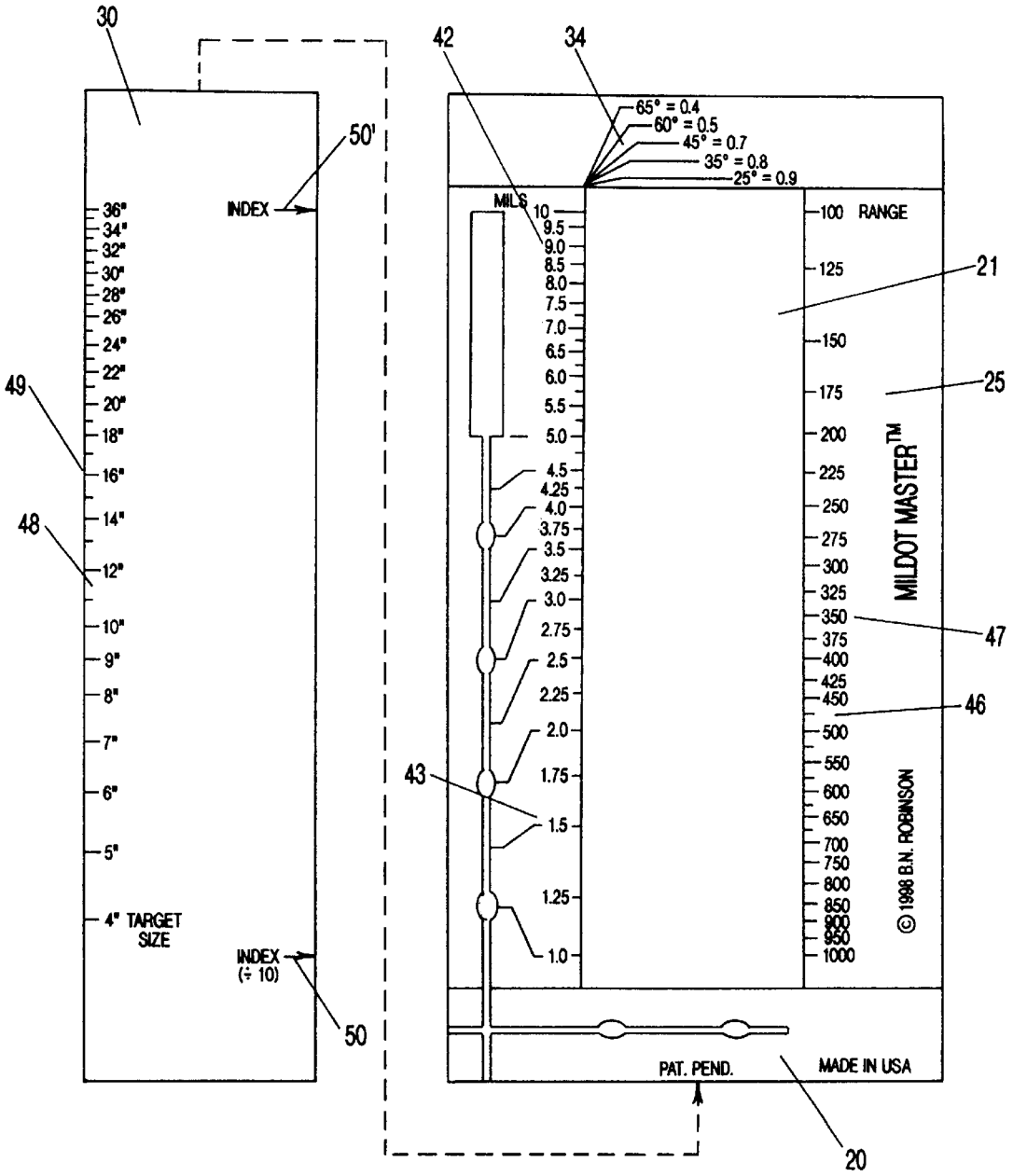
FIG. 2 is a plan view of the obverse face of the embodiment shown in FIG. 1, showing the rangefinder scales in one position.

Reference is made to FIG. 2, showing one preferred arrangement of the rangefinder scales appearing on the obverse face 25 of the calculator 10. The rangefinder scales are used to calculate the range to a target. The rangefinder scales collectively include an enlarged facsimile 40 of a portion of a mildot reticle, and parallel thereto, a mildot scale 42, both of which are printed, engraved, or otherwise presented upon, for example as illustrated, the left-hand side of the first rule member 20. (Throughout this disclosure, "top," "bottom," "left" and "right" will be used in the conventional manner to describe the apparatus of the invention as it appears in FIGS. 2–5, depicting the typical orientation of the apparatus when manipulated in the user's hands.) Running along the right hand side of the first rule member 20 is a first range scale 46. Thus, preferably, the aperture 21 is disposed parallel between the mildot scale 42 and the first range scale 46. As also seen in FIG. 2, disposed along the left-hand edge of the second rule member 30, substantially parallel to the mildot scale 42, is a target dimension scale 48.

The reticle facsimile 40 is an enlarged reproduction of a quarter section of a complete reticle, and preferably, but optionally, is provided upon the obverse face 25 to aid the user in mentally associating information viewed through the scope with the values set forth on the mildot scale 42. The invention may be practiced without referring to the reticle facsimile 40.

The mildot scale 42 comprises a plurality of mil value marks 43. As seen in FIG. 2, the mil value marks 43 are sequential numerals representing various corresponding values taken from the reticle. The typical horizontal or vertical line of a mildot reticle features ten mildot intervals (including the intersection point of the cross hairs). The mildot scale 42 accordingly features numerical values from 1.0 to 10.0, preferably labeled in intervals of 0.25. Notably, the mildot scale 42 is a common (Briggsian) logarithmic scale, with the mil value marks 43 spaced along the scale 42 logarithmically rather than uniformly. The mil value marks 43 are arranged in a logarithmic order from 1.0 at the bottom of the scale 42, near the bottom of the calculator 10, to 10.0 at the top, with the logarithmic spacing intervals decreasing from bottom to top as seen in FIG. 2. FIG. 2 also depicts how each mil value mark 43 preferably has an associated indicator line extending perpendicularly from the mark 43 to the edge of the aperture 21 to promote accurate observation of the registration between the mil value mark 43 and any one of the dimension value marks 49.

The target dimension scale 48 comprises a plurality of dimension value marks 49. As seen in FIG. 2, the dimension value marks 49 are sequential numerals representing various values corresponding to the dimension (known or estimated) of a given target. The typical target may have a horizontal or vertical dimension of between zero and about 36 inches. The target dimension scale 48 accordingly features numerical values from 4.0 to 36.0 (i.e. inches), preferably labeled in intervals of 1.0 inch. Like the mildot scale 42, the target dimension scale 48 is a common logarithmic scale, with the dimension value marks 49 spaced along the scale 48 logarithmically. The dimension value marks 49 are arranged in a logarithmic order from 4.0 at the bottom of the scale 48, nearer the bottom of the second rule member 30, to 36.0 at the top, with the logarithmic spacing intervals decreasing in size from bottom to top. FIG. 2 also shows that each dimension value mark 49 preferably has an associated indicator line extending perpendicularly from the mark 49 to the left edge of the second rule member 30 to promote accurate observation of the registration between a dimension value mark 49 and any one of the mil value marks 43.

The first range scale 46 comprises a plurality of first range value marks 47. As seen in FIG. 2, the first range value marks 47 are sequential numerals representing various values corresponding to the determined distance to a given target. The typical high-powered rifle target may have a distance, from the barrel, of between 100 and about 1000 yards. The first range scale 46 accordingly features numerical values from 100 to 1000 (i.e. yards), preferably labeled in intervals of 10 yards. Like the mildot scale 42 and the target dimension scale 48, the range scale 46 is a logarithmic scale, with the first range value marks 47 spaced along the scale 46 logarithmically. The range value marks 47 are arranged in an inverse logarithmic order from 1000 at the bottom of the scale 46, nearer the bottom of the first rule member 20, to 100 at the top, with the logarithmic spacing intervals increasing in size from bottom to top. FIG. 2 also shows that each first range value mark 47 preferably has an associated indicator line extending perpendicularly from the mark 47 to the right edge of the aperture 21 to promote accurate observation of the registration between a first range value mark 47 and either one of the first index marks 50, 50'.

The obverse side of the second rule member 30 is provided with at least one, and preferably two first index points 50, 50' thereon. Both index points are situated on the right hand edge of the second rule member 30 so as to be proximate to the range scale 46. The lower index point 50 is located nearer the bottom end of the second rule member 30, and the upper index point 50' is provided nearer the top end. As illustrated in FIG. 2, the index points are longitudinally spaced apart by a longitudinal distance approximately equal to the length of the first range scale 46, so that when the second rule member 30 is controllably moved to align the bottom index point 50 with the bottom range value mark (e.g. 1000), the upper index point 50' is aligned with the top range value mark (e.g. 100). Less desirable alternative embodiments of the calculator 10 may be crafted with only one index point, ordinarily the lower index point 50. While functional, such alternative embodiments have a range of calculation somewhat limited by the lone index point's moving physically beyond the extreme value on the first range scale 46.

As depicted in FIG. 2, the mildot scale 42, the target dimension scale 48, and the first range scale 46 have equal longitudinal extent. The respective upper and lower termini of the mildot scale 42 and the first range scale 46 are longitudinally aligned in fixed positions on opposite sides of the aperture 21; imaginary lines running perpendicular to the longitudinal axis of the calculator 10 and passing through a terminus of one of the scales 42, 46 also passes through the terminus of the other scale. Similarly, the second rule member 30 can be controllably moved to co-align simultaneously the termini of the target dimension scale 48 and the first index points 50, 50' with the termini of the scales 42, 46 disposed upon the first rule member.

Figure 3:
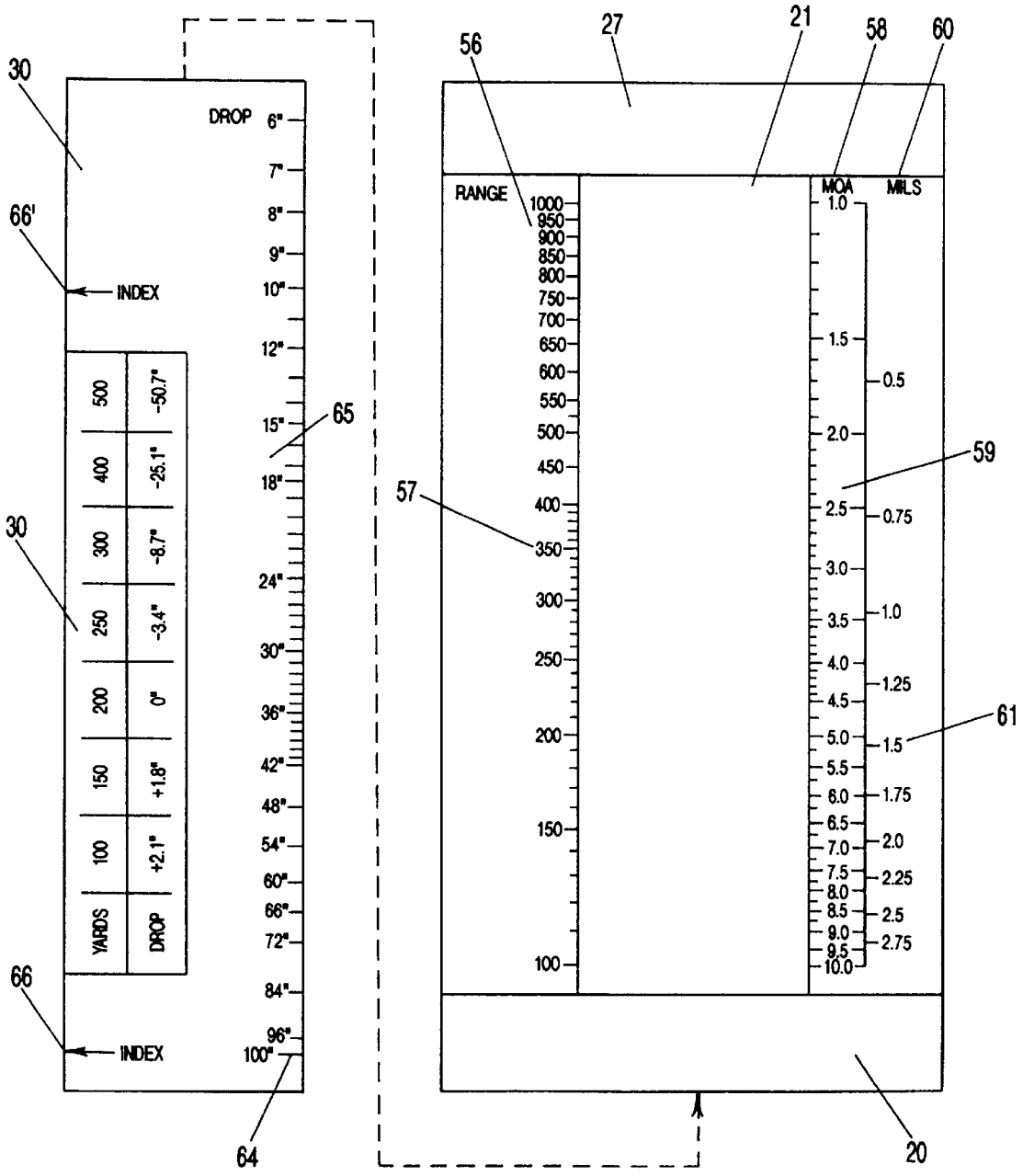
FIG. 3 is a plan view of the reverse face of the embodiment shown in FIG. 1, showing the elevation adjustment scales in one position.

The elevation adjustment scales are used to determine the appropriate adjustment in the elevation of the gun barrel to compensate for bullet drop over the distance to target. Alternatively, the elevation adjustment scales may be used to compensate for bullet drift due to the effects of wind. The determination of compensation for wind drift is performed in a manner very similar to the determination of drop compensation, and will be apparent to one skilled in the art. In the specification and the claims, "drop" may generally be read to include "drift" unless otherwise indicated. Such actual drop and drift compensations ordinarily are accomplished by adjusting the telescopic sight, or by "holding over" the cross hairs above (or to the side of) the image of the target viewed through the scope. FIG. 3 shows one preferred arrangement of the elevation adjustment scales appearing on the reverse face 27 of the calculator 10. The elevation adjustment scales preferably are axially reversed with respect to the rangefinder scales, so that if the reverse face 27 is viewed merely by rotating the calculator 10 axially, the elevation adjustment scales will appear upside down. Accordingly, the reverse face 27 is viewed by flipping the calculator 10 over and rotating it around an axis normal to the faces 25, 27 to bring the reverse face 27 into the position seen in FIG. 3.

The elevation adjustment scales collectively include a second range scale 56 along the one side of the first rule member 20, and at least one, and preferably two, elevation scales 58, 60 on the other side of the first rule member. Preferably, the aperture 21 is disposed parallel between the second range scale 56 and the elevation scales 58, 60. The second rule member 30 has a bullet drop scale 64 along one edge substantially parallel and adjacent to the elevation scales 58, 60. On the other edge of the second rule member 30 are one or two second index points 66, 66'.

The second range scale 56 is similar to the first range scale 46, and comprises a plurality of second range value marks 57. As seen in FIG. 3, the second range value marks 57 are sequential numerals representing various values, e.g. 100 yards to 1000 yards, corresponding to potential distances to a particular target. The second range scale 56 accordingly features numerical values from 100 to 1000 (i.e. yards), preferably labeled in intervals of 10–25 yards, spaced along the scale 56 logarithmically. The range value marks 57 are arranged in an inverse logarithmic order from 100 at the bottom of the scale 56, nearer the bottom of the first rule member 20 as viewed in FIG. 3, to 1000 at the top, with the spacing intervals decreasing in size from bottom to top. FIG. 3 also shows that each second range value mark 57 preferably has an associated indicator line extending perpendicularly from the mark 57 to the left edge of the aperture 21 to promote accurate observation of the registration between a second range value mark 57 and either one of the second index marks 66, 66'.

The reverse side of the second rule member 30 is provided with at least one, and preferably two second index points 66, 66' thereon. Both second index points 66, 66' are situated on the left hand edge of the second rule member 30, as viewed in FIG. 3, so as to be proximate to the second range scale 56. The lower index point 66 is located nearer the bottom end of the second rule member 30, and the upper index point 66' is provided nearer the top end. As illustrated in FIG. 3, the index points are spaced apart by a longitudinal distance equal to the length of the second range scale 56, so that when the second rule member 30 is controllably moved to align the bottom index point 66 with the bottom range value mark (e.g. 100), the upper index point 66' is aligned with the topmost range value mark (e.g. 1000).

Opposite the index points 66, 66' on the second rule member 30 is the bullet drop scale 64, including a plurality of drop value marks 65. Projected over a distance of from 100 to 1000 yards, the bullet shot from a typically loaded firearm will drop, due to the force of gravity. As seen in FIG. 3, the drop value marks 65 are sequential numerals representing various values (e.g. 1.0 inch to 100 inches) corresponding to the bullet drop for a given shot. The bullet drop scale 64 accordingly features numerical values from, for example, 10 to 96, preferably labeled in intervals of 1.0 inch (except the first labeled partial interval from 10 to 12), spaced along the scale 64 logarithmically. The drop value marks 65 are arranged in logarithmic order from 96 at the bottom of the scale 64, nearer the bottom of the first rule member 20 as viewed in FIG. 3, to 6.0 at the top, with the logarithmic spacing intervals increasing in size from bottom to top. FIG. 3 also shows that each drop value mark 65 preferably has an associated indicator line extending perpendicularly from the mark 65 to the right edge of the second rule member 30 to promote accurate observation of the registration between any drop value mark 65 and any of the elevation value marks 59, 61.

The elevation scales 58, 60 are upon the opposite side of the aperture 21 from the second range scale 56. The invention functions with either of the elevation scales 58, 60 used singly, but the preferred embodiment is provided with dual scales 58, 60 to permit the user to select the better of two available modes of elevation adjustment in a given situation. A minute-of-angle (MOA) elevation scale 58 is provided parallel alongside a mil elevation scale 60.

The MOA elevation scale 58 comprises a plurality of minute-of-angle elevation value marks 59. As seen in FIG. 3, the MOA elevation value marks 59 are sequential numerals representing various values corresponding to a determined adjustment to barrel elevation, measured in angle minutes, needed to compensate for a known bullet drop. The elevation of a typical high-powered rifle, with a typical cartridge load, may need to be adjusted anywhere from 1.0 to 10.0 minutes (or multiples thereof), for example, to compensate for the bullet drop over a distance of 100 to 1000 yards. The MOA elevation value scale 58 accordingly features numerical values from 1.0 to 10.0, preferably labeled in intervals of 0.25 minutes. The MOA elevation scale 58 is a logarithmic scale, with elevation value marks 59 spaced along the scale 58 logarithmically from 10.0 at the bottom of the scale 58, nearer the bottom of the first rule member 20, to 1.0 at the top, with the logarithmic spacing intervals increasing in size from bottom to top. FIG. 3 also shows that each MOA elevation value mark 59 preferably has an associated indicator line extending perpendicularly from the mark 59 to the left edge of the aperture 21 to promote accurate observation of the registration between an elevation value mark 59 and any one of the bullet drop value marks 65.

The mil elevation scale 60 comprises a plurality of mil elevation value marks 61. As seen in FIG. 3, the mil elevation value marks 61 are sequential numerals representing various values corresponding to a determined adjustment to barrel elevation, measured in milliradians (mildots viewed through the scope), needed to compensate for a known bullet drop. A milliradian approximately equals 3.438 minutes of angle. The elevation of a typical high-powered rifle, with a typical cartridge load, may need to be adjusted anywhere from 0 to 2.5 mils, or multiples thereof for example, to compensate for the bullet drop over a distance of 100 to 1000 yards. The mil elevation scale 60 accordingly features numerical values from 0 to at least 2.5, preferably labeled in intervals of 0.25 mils. The mil elevation scale 60 is a logarithmic scale, with elevation value marks 61 spaced along the scale 60 logarithmically from about 2.5 at the bottom of the scale, as viewed in FIG. 3, to about 0.0 at the top, with the spacing intervals increasing in size from bottom to top.

The distance a bullet drops due to gravity, over a given range, is a function of several variables. The most important factors are the type of firearm used, and the "load" on the bullet cartridges fired. The higher the "load," the higher the bullet velocity and hence a reduced amount of drop. Load can be affected by the quantity and the quality of the gunpowder in the cartridges in use. The amount of drop for a given range, for a given firearm, must accordingly be determined before going into the field. It is known in the art to determine the bullet drop from information provided by the firearm and cartridge manufacturers, or from testing.

The user of the calculator 10 of the present invention therefore must have access in the field to a means for correlating range to target with bullet drop. For example, the user will need to know, or have ready access to a reference showing, that at a range of 250 yards his particular gun and load will result in a drop of approximately 3.4 inches, that at range 300 yards the drop increases to about 8.7 inches, and at 500 yards the drop is about 50.7 inches, and the like. Presently, the long range shooter commonly carries into the field a small chart tabulating the specific range-to-target and corresponding bullet drop values for his particular firearm and load. This chart frequently is carried taped to the stock of the firearm. The present calculator 10 features an elongated space upon the reverse side of the second rule portion 30 where such a customized drop chart 33 may be temporarily affixed. The drop chart 33 thus is conveniently located for reference during the practice of the invention. The space on the calculator 10 may be sized, for example, to receive thereon a DROP DECAL™ available from EXD Engineering, Inc. of Lawrence, Kan., USA, with the proper range and drop data entered thereon. Alternatively, the user may choose to simply prepare his own version of the drop chart 33 on an appropriately sized sheet of paper, and affix the chart to the calculator using transparent tape or the like. The user should then verify the accuracy of his chart by sight testing his firearm prior to entering the field. Thus, the drop chart 33 serves as a means, preferably on the second rule member 30, for determining a bullet drop value for the previously determined known distance.

Range calculations, whether performed having reference to a mildot reticle or by some other means, are a measure of the "line-of-sight" distance to the target. Bullet drop figures, however, are always expressed in terms of deviation from a horizontal trajectory. It is important to note, therefore, that bullet drop figures are not accurate if a particular shot is uphill or downhill by approximately 25° or more. The range determination on such shots must be adjusted to promote accurate shooting. If shooting uphill or down hill (for example, when hunting in mountainous terrain), the user must estimate the angle by which the shot deviates from horizontal, and reduce the estimated range accordingly. This lesser "actual horizontal range" determines the actual bullet drop, and is the basis of the calculations performed for sight adjustment or hold-over corrections. Whether a particular shot is uphill or downhill is not relevant, the affect on bullet drop is the same; the actual horizontal range is less than the angled line-of-sight range.

The calculator 10 optionally may be provided on a face thereof with a range correction graph 34 to assist in making the conversion form line-of-sight distance to actual horizontal range. The range correction chart 34 graphically expresses the information which allows a quick conversion of estimated line-of-sight range into actual horizontal range. Once the user has used the mildot reticle and the rangefinders scales of the calculator 10 to determine the line-of-sight range, a reference to the graph 34 would provide the correction factor (a value less than unity) multiplier to be applied to determine the actual horizontal range. Thus, the graph 34 functions as a means, preferably on the first rule member 20, for determining a range correction factor for vertically angled shots. The bullet drop figure may then be properly selected using the actual horizontal range.

The operation of the apparatus of the invention is now described by way of example. In the field, a target such as a deer is identified. The deer is viewed through the telescopic sight having a mildot reticle. The user estimates the actual size of the target by, for example, estimating the breadth of the deer's breast to be 18 inches. (If the target size cannot be confidently estimated, or if the target is very small, a "reference target," i.e. an object whose size can be accurately estimated, which is the same distance from the user and nearby the actual target, is selected and viewed through the scope. An example of the later situation would be a deer of unknown size standing next to a fence estimated to be five feet high; the fence could be used as the reference target.) The user then views the deer through the scope, carefully observing how many intervals (e.g. spaces between mildots), including fractional intervals, on a reticle are occupied by the deer's breast when viewed through the scope. In this example, the deer's breast is observed to occupy 1.5 mildot intervals.

Figure 4:
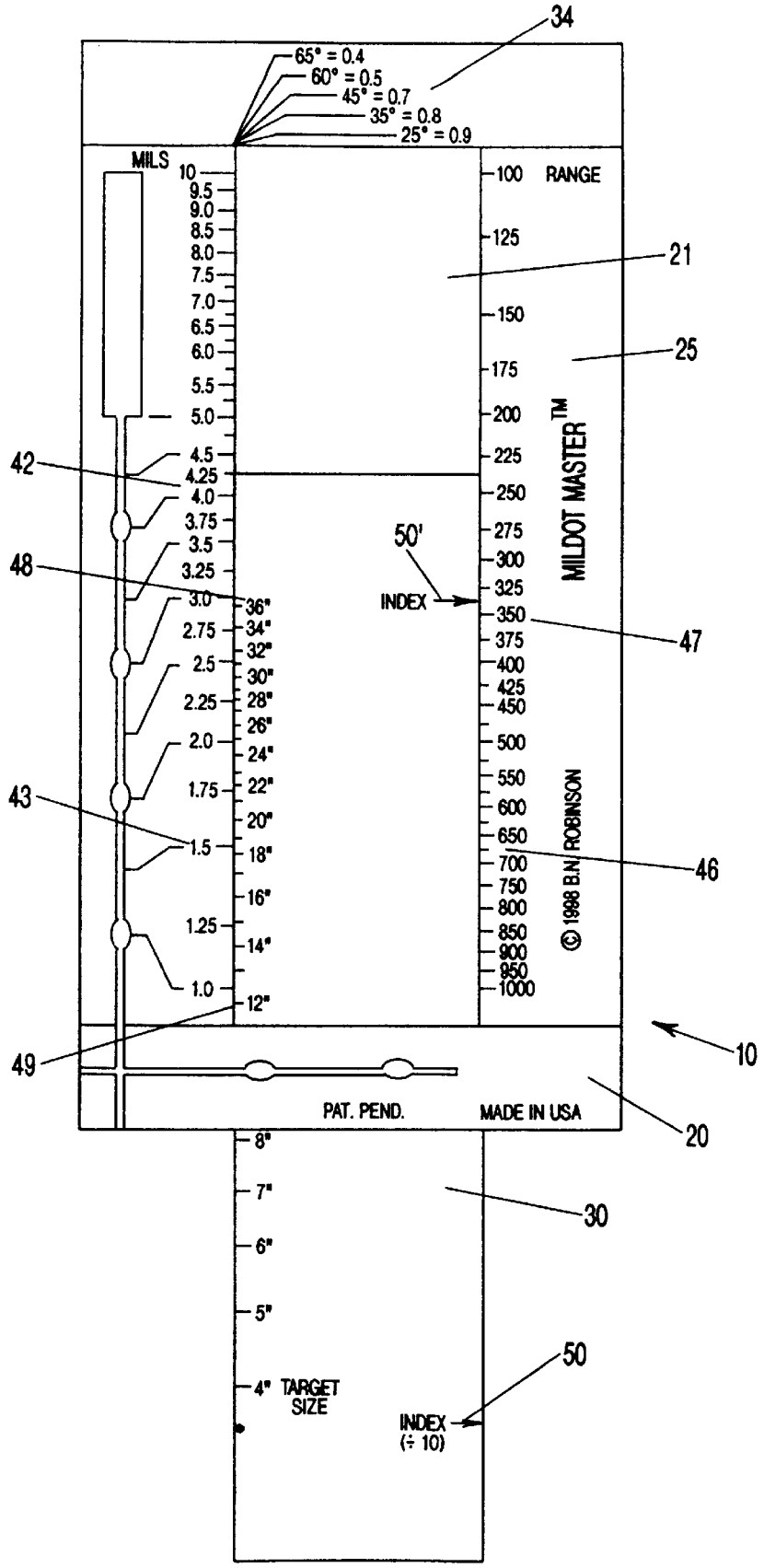
FIG. 4 is a plan view of the rangefinder scales in another position for making a particular calculation.

The calculator is taken in hand with the obverse face 25 in plain view. The second rule member 30 is controllably moved with respect to the first rule member 20 to align the dimension value mark 49 corresponding to the estimated target dimension (in this example, 18") with a mil value mark 43, in this example 1.5, selected to correspond to the mildot interval occupied by the target. With the 18-inch dimension value mark on the target dimension scale 48 thus aligned with the selected mil value mark of 1.5 on the mildot scale 42, the obverse face 25 of the calculator will be in the position shown in FIG. 4. Referring to FIG. 4, it is seen that with the 18" dimension value mark aligned with the 1.5 mil value mark, the upper index point 50' is aligned between the range value marks corresponding to ranges of 300 yards and 350 yards, near the mark corresponding to 330 yards. The user visually reads (or interpolates, if necessary on a less finely divided scale) that the upper index point 50' is aligned with the range value mark of 330 yards. The upper index point 50' thus is aligned with a range value mark corresponding to the distance to the target. The line-of-sight range to target is thereby determined to be about 330 yards.

The apparatus is designed such that, with the wide range of combinations of target dimensions and mildot measurements, one of the first index points 50, 50' will align with a first range value mark 47 for practically every determined combination. For a given calculation, the user simple uses whichever one of the two first index points 50, 50' is aligned with a range value. If the estimated target dimension is greater than the maximum value on the target dimension scale 48, the user simply selects a dimension value mark 49 corresponding to half the estimated size, and then doubles the resulting range value to determine the actual range to target.

Once the range to target has been determined the user must now either adjust the telescopic sight or change the sight picture (hold-over) to compensate for the bullet drop at the determined range. A second calculation accordingly must be performed in order to convert bullet drop at the determined range into an appropriate elevation correction factor. The present invention simplifies this process by performing both sight adjustment and hold-over calculations simultaneously, for the specific bullet drop figure at a specific range.

Figure 5:
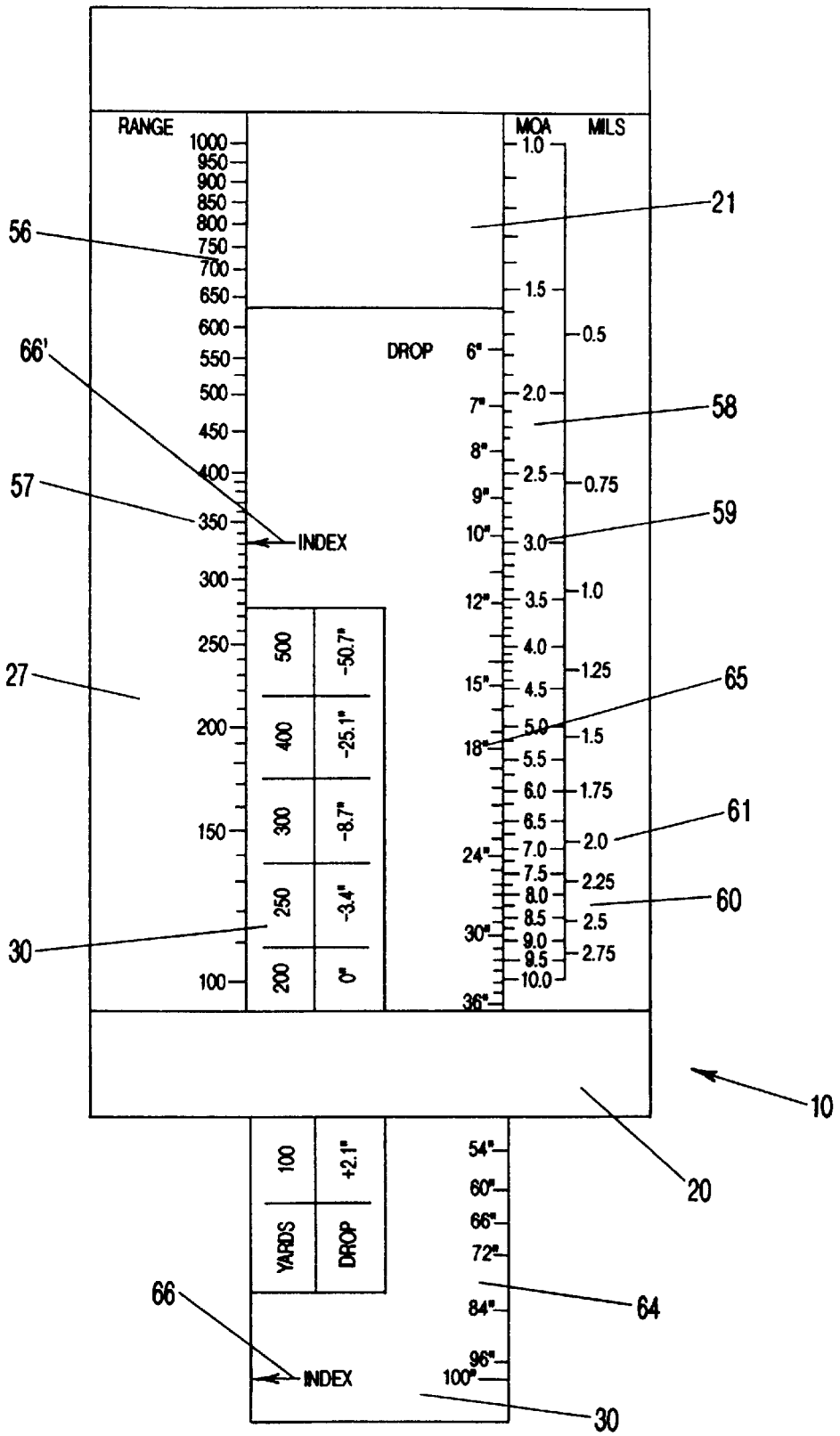
FIG. 5 is a plan view of the elevation adjustment scales in another position for making a particular calculation.

The calculator 10 is obverted to place the reverse face 27 in plain view as seen in FIG. 5. The second rule member 30 is controllably moved (if necessary) to align one of the second index points 66, 66', in this example the upper index point 66', with the second range value mark 57 (on the second range scale 56) corresponding to the determined range, in this example, 330 yards. Consulting the drop chart 33 on the second rule member 30 or elsewhere, the user interpolates that, for the known load and firearm, the bullet drop over 330 yards is about 10 inches (i.e. as interpolated between the values −8.7" and −25.1" appearing correspondent the range values of 300 yards and 400 yards, respectively, manifested on the drop chart 33). With the index point 66' aligned with the range value mark corresponding to 330 yards, the drop value mark 65 corresponding to the ascertained drop value (e.g. 10 inches) is automatically approximately aligned with the determined elevation adjustment values readable from either of the elevation scales 58, 60. In this example, as seen in FIG. 5, the drop value mark corresponding to 10" is aligned with the minute-of-angle mark corresponding to a MOA value of 3.0 on the MOA elevation scale 58, and a mil value of about 0.8 mils on the mil elevation scale 60. Accordingly, the determined elevation adjustment values are 3.0 minutes-of-angle, and 0.8 mils. The user can select either one of the determined elevation adjustment values for use. The user corrects for the amount of drop by either holding over by 0.8 mildots in the reticle when the target is viewed through the scope, or by adjusting the elevation of the telescopic sight to raise the point of impact by 3.0 MOA.

Of course, if one index point 66 used with a determined range and bullet drop value puts the bullet drop value mark 65 "off the scale", the second rule member 30 simply is controllably moved to place the other index point 66' in alignment at the proper location along the second range scale 56, which will place the drop value mark 65 (in this example, 10") in alignment with the appropriate MOA and mil elevation marks 59, 61.

If the bullet drop value is less than the minimum value appearing on the bullet drop scale 64, the actual value may simply be doubled and the value corresponding to the resulting product used on the bullet drop scale 64. Half of the indicated correction amount is then used to compensate for the actual drop.

The calculator 10 may be configured so that when the proper registrations have been made on the obverse face 25 to determine the range to target for certain ranges, the calculator need merely be turned over to reveal the proper elevation adjustment values, without any need to further manipulate the rule members 20, 30 (assuming the required bullet drop for that range is not off-scale). Stated differently, in one preferred embodiment of the invention, the rangefinder scales and the elevation adjustment scales are so arranged such that the alignment of the proper respective values on the first range scale 46 and the mildot scale 42 will automatically and simultaneously result in the proper alignment of the proper bullet drop value on the bullet drop scale 64 with the correct elevation adjustment values on the elevation scales 58, 60.

In the foregoing example, the shots were assumed to be taken on the horizontal. If the shot were to be taken, for further example, uphill at an angle of 45° the determined line-of-sight value (e.g. 330 yards, would be greater than the actual horizontal range that the bullet would travel. A bullet drop value selected from the drop chart 33 would thus be excessive, and the actual point of impact would be too high. By referring to the horizontal range correction graph 34 on the obverse side 25 of the calculator 10, the user notes that a 45-degree slop indicates a correction factor of 0.7. This correction factor allows a quick conversion of estimated line-of sight range into actual horizontal range. The example, the line-of-sight range (330 yards) is multiplied by the correction factor of 0.7, yielding an actual horizontal range of approximately 230 yards. The user refers to the drop chart 33, but applies the corrected range of 230 yards to the drop chart 33 to determine the proper bullet drop value to be utilized in further calculation of the elevation adjustment. But because the line-of-sight distance to target is still 330 yards, the second index point 66' nevertheless is aligned with the line-of-sight value of 330 yards; only the selected bullet drop value mark 65 on the bullet drop scale 64 is changed to account for the angle of the shot.

The shooter of ordinary skill also is able to use the calculator 10 to determine adjustments to windage account for wind drift. Wind drift can be estimated by several methods known in the art, and the shooter must develop drift estimation skills to ensure consistent long-range hits under windy conditions. The calculator 10 may be utilized to convert a wind drift estimation into a sight adjustment figure (MOA) or a hold-over figure (mils) in the same manner as determining a bullet drop correction.

Notably, all the scales 42, 46, 48, 56, 58, 60 and 64 are herein exemplified as each having a finite quantity of value marks physically spaced logarithmically. It will be immediately appreciated by a person of ordinary skill in the art that it is not pragmatic, or even possible, to provide any scale with an infinite quantity of value marks physically spaced apart by infinitesimally small intervals. Accordingly, when the calculator 10 is in proper use, an index point 50 or 50' or 66 or 66', or some selected value mark on one scale, will not align perfectly with a specifically labeled value mark on another scale for all potential calculations. Accordingly, it is understood that in this description and in the claims, the concept of "alignment" of an index point or a value mark on one scale with a value mark on some other scale includes the practice of visual or mental interpolation of values from the other scale in those instances when exact registration between labeled value marks is not achieved.

Figure 6:
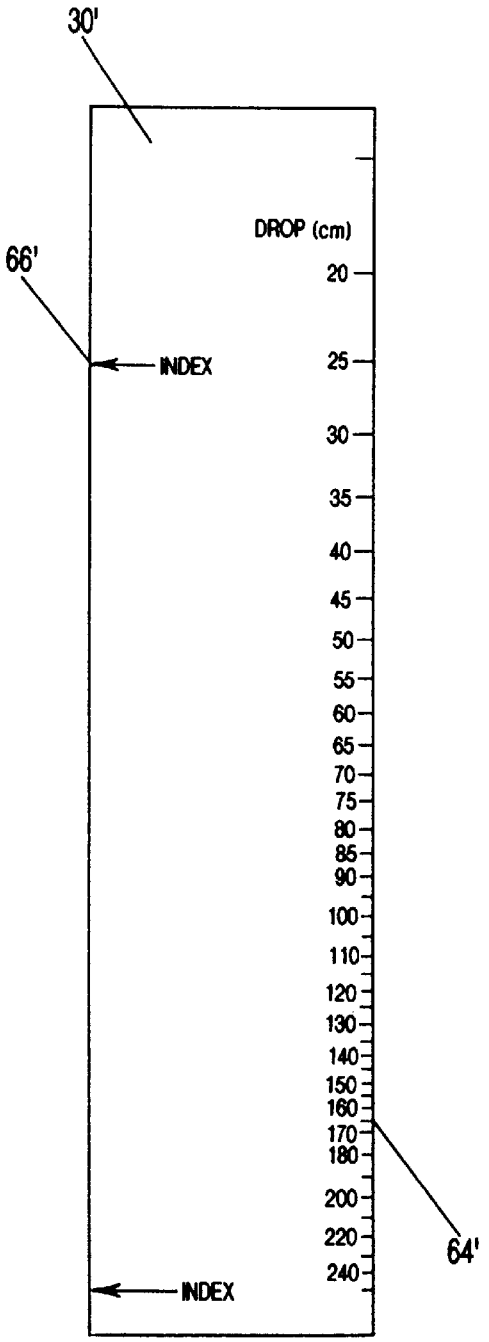
FIG. 6 is a plan view of an alternative embodiment of the second rule member shown in FIG. 3.
Figure 7:
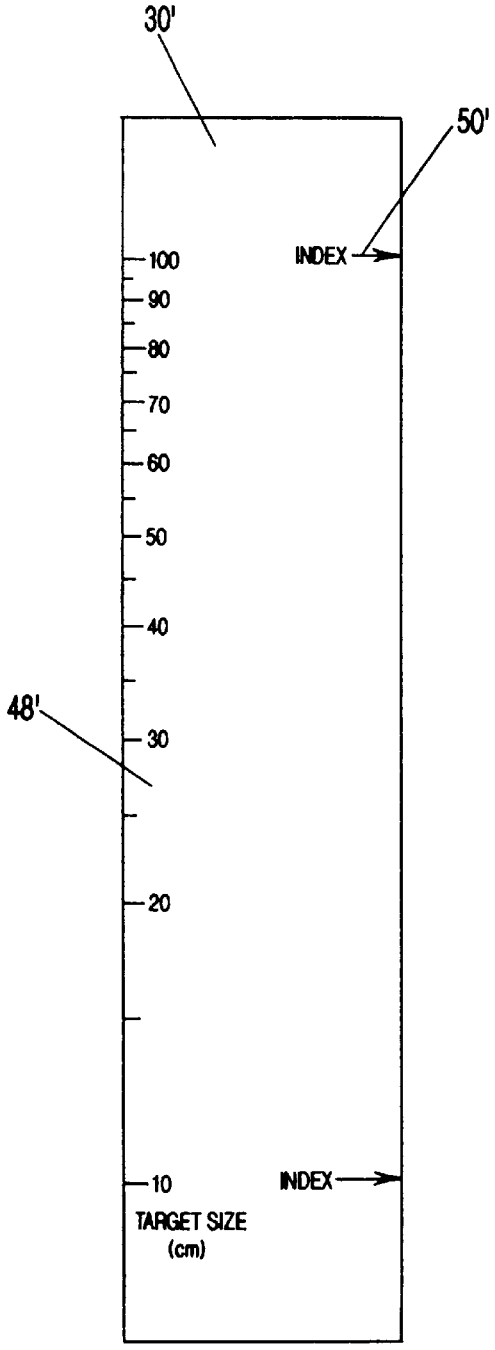
FIG. 7 is a plan view of an alternative embodiment of the second rule member shown in FIG. 2.

A distinct advantage of the invention is that the second rule member 30 is interchangeable to permit the calculator 10 to be adapted to either English (yards and inches) or metric (meters and centimeters) calculations. Reference to FIGS. 2 and 3 reveals that the range scales 46, 56 are not specifically limited to or labeled to pertain to "yards." The range scales 46, 56 accordingly may also be used whereby the first and second range value marks 47, 57 denote meters, rather than yards. FIGS. 6 and 7 show the reverse and inverse faces, respectively, of an alternative embodiment of the second rule member 30 useable to perform metric calculations. The metric second rule member 30' is substantially the same as the English second rule member 30, except that the target dimension scale 48' (FIG. 7) is labeled in centimeters, e.g. 10 cm to 100 cm, rather than inches, and the bullet drop scale 64' (FIG. 6) is labeled in centimeters, e.g. 20 cm to 240 cm, rather than inches.

The metric second rule member 30' is sized and shaped substantially identically to the English second rule member 30. Consequently, the two second rule members 30 and 30' are physically interchangeable for insertion into and axial movement in relation to the first rule member 20. To adapt his calculator 10 for metric use, the user of the invention simply slides the English second rule member 30 out of the first rule member 20, and inserts the metric second rule member 30' in lieu thereof and in the same relative orientation. The calculator 10 may then be used in the same manner, regarding the manipulation of the rule members 20 and 30', as previously explained herein. Only the dimensional system is different, and the dimensional conversions are automatically performed by the use of the metric second rule member 30'. The proper readout is still obtained from the first range scale 46 (interpreted in meters) and from the MOA and mil elevation adjustment scales 58, 60.

Figure 8:
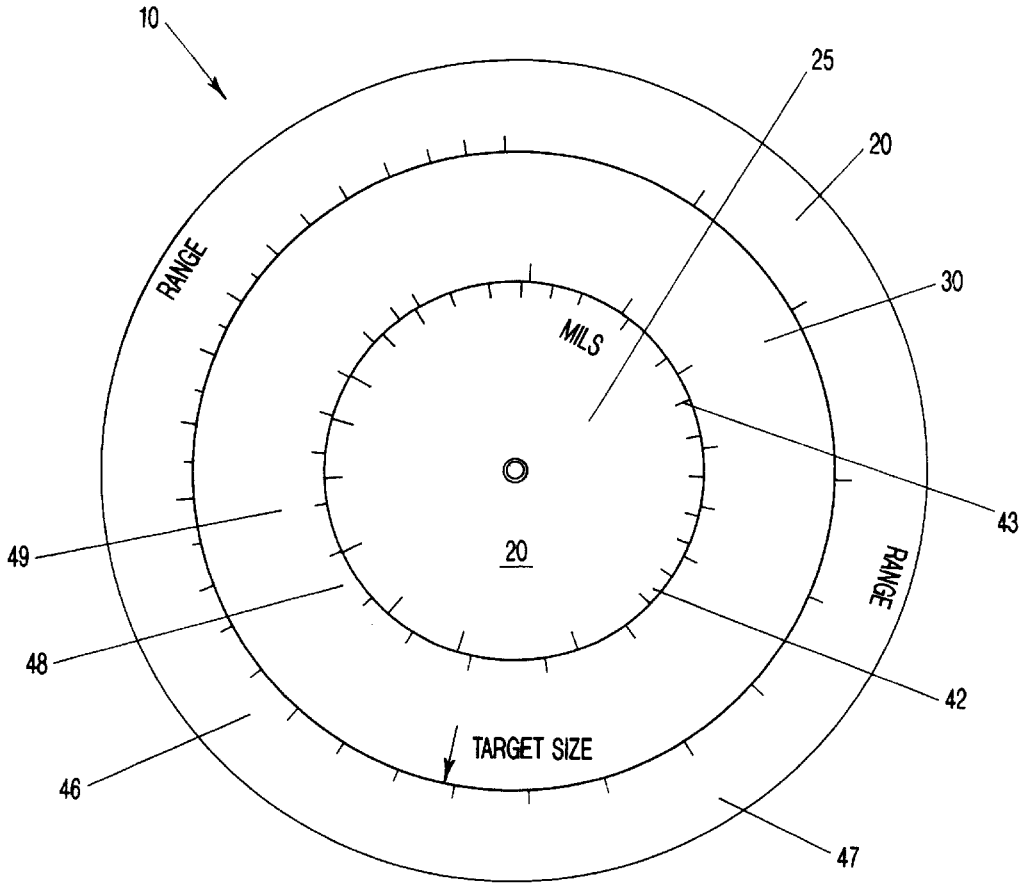
FIG. 8 is a plane view of the obverse face of an alternative embodiment of the invention shown in FIG. 2.
Figure 9:
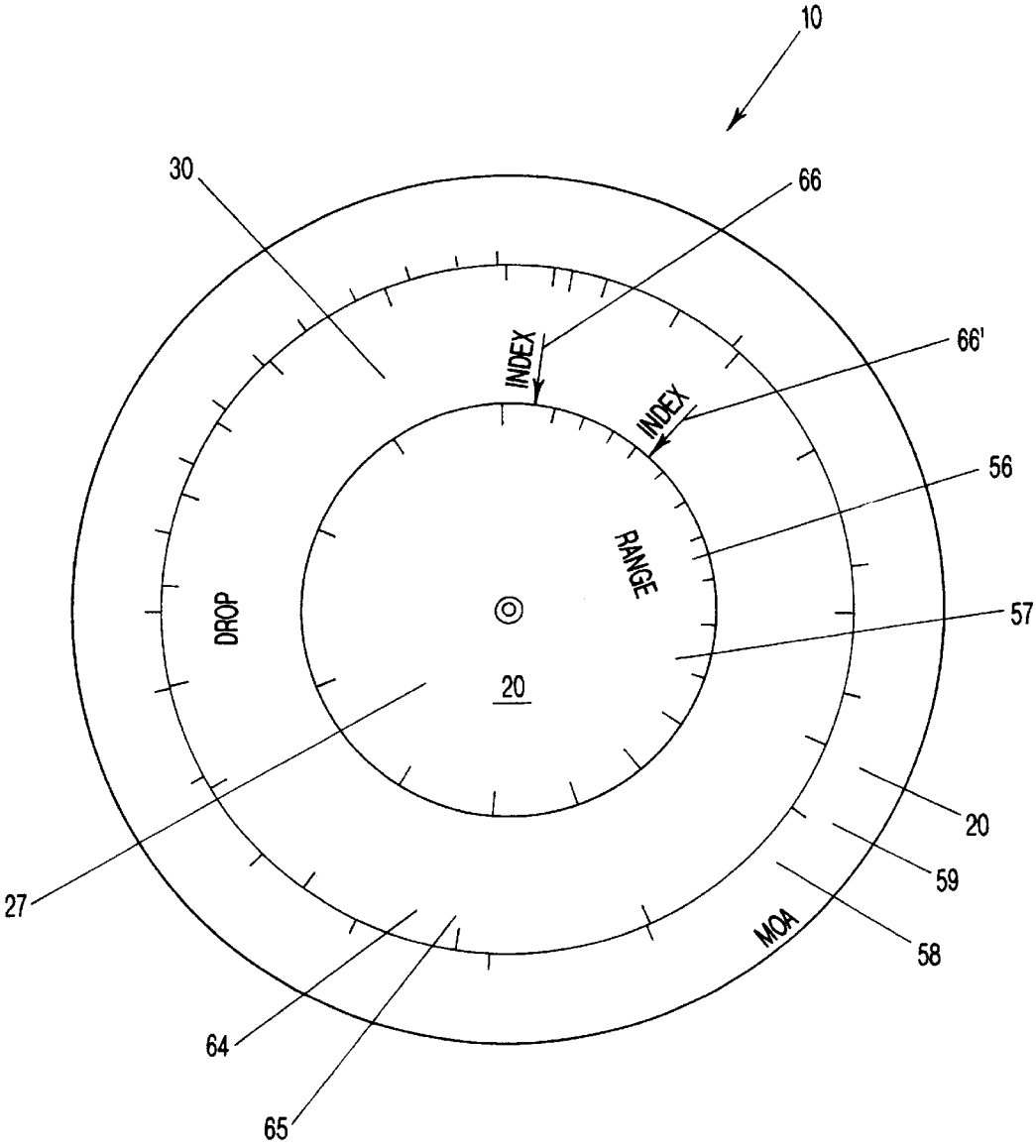
FIG. 9 is a plan view of the reverse face of the alternative embodiment of the invention shown in FIG. 8.

While the preferred embodiment of calculator 10 is here characterized as generally rectangular with the two rule members 20, 30 capable of reciprocating, mutually parallel longitudinal movement, a person of skill in the art will immediately appreciate that the calculator 10 may be otherwise shaped without departing from the scope and spirit of the invention. The only practical limitation confining the design of the apparatus of the invention is that the rangefinder scales are maintained in parallel relation to each other throughout their range of selected movement, and likewise that the elevation adjustment scales remain in mutually parallel relation. Consequently, alternative embodiments of the inventive calculator 10 potentially may take the shape, for example, of a circular disc, rotatably mounted within a circular frame, the disc and the frame having circumferential and/or circular scales or window apertures which can be selectively aligned radially. One possible such circular embodiment is depicted in FIGS. 8 and 9, in which the reference numbers identify elements corresponding generally to elements having those reference numerals in FIGS. 1–7. The disc is concentrically sandwiched within the circular frame, and the two elements are joined by a common central pivot. The user rotates the central disc to register, for example, an index on the disc with a window in the frame, permitting a determined value to be read by noting where a certain mark on the disc perimeter aligns with another mark on a circular scale on the frame.

Because the calculator 10 can be used easily to convert a bullet drop figure into a telescopic sight adjustment figure, independently from the calculation of range to target, the inventive apparatus may be used with non-mildot-type scopes. For example, it is apparent that the elevation adjustment aspect of the invention may be used in operative combination with optical or laser rangefinders.

A number of advantages of the invention are thus apparent. Since the target dimension scale preferably is in increments of inches, no conversion of estimated target size from inches into decimal equivalent of yards is necessary. No entry of data or operations through a keypad is needed, as the apparatus is truly analog and only requires the alignment of indices and scales. The user need not memorize any formulae, as the correct formulae are "built into" the scales. The user is freed from having to perform complex calculations for determination of telescopic sight adjustment or holdover at various ranges, because the reverse side of the apparatus converts drop/drift figures directly into both minute-of-angle and mils. The speed of the calculations necessary to determine range to target and required telescopic sight adjustment and/or hold-over is significantly reduced by employing the invention in lieu of a hand-held electronic calculator. The apparatus is includes only two main parts, utilizes no electrical or electronic parts, and requires no batteries; its simplicity of construction and operation results in extreme reliability under adverse conditions.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents.

What is claimed is:

1. An apparatus, useable with a telescopic sight having a mildot reticle, for determining the distance to a target of a known dimension, the apparatus comprising:

a first rule member;

a second rule member controllably moveable adjacent to said first rule member;

a mildot scale, comprising mil value marks, on said first rule member;

a range scale, comprising range value marks, on said first rule member;

at least one index point on said second rule member proximate to said range scale;

a target dimension scale substantially parallel to said mildot scale, said target dimension scale comprising dimension value marks on said second rule member; and wherein when said second rule member is moved to align a dimension value mark corresponding to the known dimension with a selected mil value mark on said mildot scale, one of said at least one index points is substantially aligned with a range value mark corresponding to the distance to the target.

2. An apparatus according to claim 1 wherein said first rule member comprises an oblong rectilinear shape defining a rectangular aperture therethrough.

3. An apparatus according to claim 2 wherein said aperture is disposed parallel between said mildot scale and said range scale.

4. An apparatus according to claim 2 wherein said second rule member comprises an oblong rectilinear shape movably disposed through slots in said first rule member.

5. An apparatus according to claim 4 wherein said second rule member is controllably movable axially within said aperture parallel to said first rule member.

6. An apparatus according to claim 1 further comprising a mildot reticle facsimile on said first rule member parallel to said mildot scale.

7. An apparatus according to claim 1 further comprising means on said first rule member for determining a range correction factor for vertically angled shots.

8. An apparatus according to claim 1 wherein said first rule member comprises a circular shape and said second rule member comprises a circular shape.

9. An apparatus according to claim 1, useable with a firearm having a known bullet drop or drift over a known distance, for determining an adjustment to firearm elevation or windage to compensate for bullet drop or drift, said apparatus further comprising:

at least one elevation scale, comprising elevation value marks, on said first rule member; and a bullet drop scale, comprising drop value marks, on said second rule member substantially parallel to said at least one elevation scale; and wherein when said second rule member is moved to align one of said at least one index point with a selected range value mark corresponding to the known distance, a drop value mark corresponding to the known bullet drop is substantially aligned with an elevation value mark on said at least one elevation scale corresponding to the adjustment to firearm elevation or windage.

10. An apparatus according to claim 9 wherein said first rule member comprises an oblong rectilinear shape defining a rectangular aperture therethrough.

11. An apparatus according to claim 10 wherein said aperture is disposed parallel between said at least one elevation scale and said range scale.

12. An apparatus according to claim 10 wherein said second rule member comprises an oblong rectilinear shape movably disposed through slots in said first rule member.

13. An apparatus according to claim 12 wherein said second rule member is controllably movable axially within said aperture parallel to said first rule member.

14. An apparatus according to claim 9 further comprising means on said second rule member for determining a bullet drop value for the known distance.

15. An apparatus according to claim 1, useable with a firearm having a known bullet drop or drift over a known distance, and useable for determining an adjustment to firearm elevation or windage to compensate for bullet drop or drift, said apparatus further comprising:

a second range scale, comprising second range value marks, on said first rule member;

at least one elevation scale, comprising elevation value marks, on said first rule member;

at least one second index point on said second rule member proximate to said second range scale; and a bullet drop scale, comprising drop value marks, on said second rule member substantially parallel to said at least one elevation scale; and wherein said second rule member is moved to align a dimension value mark corresponding to the known dimension with a selected mil value mark on said mildot scale, one of said at least one index points is substantially aligned with a range value mark corresponding to the distance to the target; and wherein when said second rule member is moved to align one of said at least one second index points with a selected second range value mark corresponding to the distance to the target, a drop value mark corresponding to the known bullet drop is substantially aligned with an elevation value mark on said at least one elevation scale corresponding to the adjustment to firearm elevation or windage.

16. An apparatus according to claim 15 wherein said apparatus comprises an obverse face and a reverse face.

17. An apparatus according to claim 16, wherein said mildot scale, said first range scale, said at least one first index point, and said target dimension scale are disposed upon said obverse side, and further wherein said second range scale, said at least one elevation scale, said at least one second index point, and said bullet drop scale are disposed upon said reverse side.

18. An apparatus according to claim 17 wherein said first rule member comprises an oblong rectilinear shape defining a rectangular aperture therethrough.

19. An apparatus according to claim 18 wherein said aperture is disposed parallel between said mildot scale and said first range scale.

20. An apparatus according to claim 18 wherein said second rule member comprises an oblong rectilinear shape movably disposed through slots in said first rule member.

21. An apparatus according to claim 20 wherein said second rule member is controllably movable axially within said aperture parallel to said first rule member.

22. An apparatus according to claim 21 further comprising a mildot reticle facsimile on said obverse face.

23. An apparatus according to claim 18 wherein said aperture is disposed parallel between said at least one elevation scale and said second range scale.

24. An apparatus according to claim 17 further comprising means on said first rule member for determining a range correction factor for vertically angled shots.

25. An apparatus according to claim 17 further comprising means on said reverse face for determining a bullet drop value for said known distance.

26. An apparatus according to claim 17 wherein said dimension value marks are labeled in increments of inches and said drop value marks are labeled in increments of inches, and further comprising a metric second rule member, interchangeable with said second rule member, having dimension value marks and drop value marks labeled in increments of centimeters.

27. An apparatus, useable with a telescopic sight having a mildot reticle, for determining the distance to a target of a known dimension, the apparatus comprising:

a first rule member;

a second rule member controllably moveable adjacent to said first rule member;

a mildot scale, comprising mil value marks, on said second rule member;

a range scale, comprising range value marks, on said first rule member;

at least one index point on said second rule member proximate to said range scale;

a target dimension scale, comprising dimension value marks, on said first rule member substantially parallel to said mildot scale; and wherein when said second rule member is moved to align a selected mil value mark on said mildot scale with a dimension value mark corresponding to the known dimension, one of said at least one index points is substantially aligned with a range value mark corresponding to the distance to the target.

* * * * *